US007313842B1

(12) United States Patent
Preciado

(10) Patent No.: US 7,313,842 B1
(45) Date of Patent: Jan. 1, 2008

(54) SHOE-MOUNTED UMPIRE'S BRUSH UNIT

(76) Inventor: René V. Preciado, 108 N. Minnesota, Las Vegas, NV (US) 89107

( * ) Notice: Subject to any disclaimer, the term of this patent is extended or adjusted under 35 U.S.C. 154(b) by 523 days.

(21) Appl. No.: 11/012,556

(22) Filed: Dec. 16, 2004

(51) Int. Cl.
*A46B 7/02* (2006.01)
*A46B 13/00* (2006.01)
*A43B 5/18* (2006.01)

(52) U.S. Cl. ..... 15/227; 15/184; 15/105; 36/113; 36/136; 36/132

(58) Field of Classification Search ..... 15/105, 15/227, 184, 159.1, 160; 36/132, 136, 126–127, 36/113; 2/245, 919
See application file for complete search history.

(56) References Cited

U.S. PATENT DOCUMENTS 2,962,744 A * 12/1960 Hodgin ..... 15/161
3,362,775 A 1/1968 Muecke ..... 401/6
3,526,014 A 9/1970 Edwards ..... 15/227
3,533,120 A * 10/1970 De Mercado ..... 15/50.1
4,856,599 A 8/1989 Stammen ..... 172/370
5,173,985 A * 12/1992 Palmer ..... 15/227
5,437,075 A * 8/1995 Peake ..... 15/161
5,461,814 A 10/1995 Reid et al. ..... 43/1
D376,880 S 12/1996 Liebscher ..... D32/35
6,092,313 A * 7/2000 Dunlap et al. ..... 36/132
6,393,648 B1 * 5/2002 Reynolds ..... 15/160
2004/0221408 A1 * 11/2004 Nagorski ..... 15/105

* cited by examiner

*Primary Examiner*—Laura C Guidotti
(74) *Attorney, Agent, or Firm*—Donald R. Schoonover

(57) ABSTRACT

A brush is mounted on the toe of an umpire's shoe and is used to clean dirt and debris from home plate. One form of the brush includes straps that encircle the shoe, while other forms of the brush include brushes that are movable.

2 Claims, 2 Drawing Sheets

SHOE-MOUNTED UMPIRE'S BRUSH UNIT

BACKGROUND OF THE INVENTION

1. Field of the Invention

The present invention relates to the general art of brushing and scrubbing, and to the particular field of brushing and scrubbing implements combined with other devices.

2. Description of the Related Art

One of the more common occurrences at a baseball game is that of the home plate umpire cleaning dirt off home plate. Umpires generally carry a brush and use that brush to clean off home plate.

In order to accomplish this task, umpires must bend over to reach the plate. Not only is this an etiquette problem, it may place stress on the umpire's back. In some cases, an umpire may forego cleaning home plate in order to avoid stressing his back.

Therefore, there is a need for a means for cleaning home plate which does not require the umpire to bend over.

While the inventor is aware of brushes that can be mounted on a shoe, the inventor is not aware of any brush that can be used by an umpire to clean home plate. A brush mounted on an umpire's shoe must be out of the way and the brushes of which the inventor is aware can get in the way and inhibit movement. An umpire must be able to move quickly in order to stay out of the way of the game and thus the brushes which are known to the inventor have significant drawbacks.

Therefore, there is a need for a means for cleaning home plate which does not require the umpire to bend over yet will remain out of the way when not in use.

Still further, any such device must be easy to use. Since the task is quite simple, any difficulty in using the device would make it unacceptable.

Therefore, there is a need for a means for cleaning home plate which does not require the umpire to bend over yet will be easy to use and will remain out of the way when not in use.

PRINCIPAL OBJECTS OF THE INVENTION

It is a main object of the present invention to provide a means for cleaning home plate which does not require the umpire to bend over.

It is another object of the present invention to provide a means for cleaning home plate which does not require the umpire to bend over yet will remain out of the way when not in use.

It is another object of the present invention to provide a means for cleaning home plate which does not require the umpire to bend over yet will be easy to use and will remain out of the way when not in use.

SUMMARY OF THE INVENTION

These, and other, objects are achieved by a brush that is mounted on the toe of a shoe, such as an umpire's shoe. The brush can be movable if desired and will be used to brush dirt and debris off of home plate.

Using the shoe-mounted brush embodying the present invention will permit an umpire to quickly and efficiently clean home plate without bending over. When not in use, the brush can be out of the way and yet will be easy to use when necessary.

BRIEF DESCRIPTION OF THE DRAWING FIGURES

DETAILED DESCRIPTION OF THE PREFERRED EMBODIMENT

Other objects, features and advantages of the invention will become apparent from a consideration of the following detailed description and the accompanying drawings.

Referring to the Figures, it can be understood that the present invention is embodied in a shoe-mounted umpire's brush unit 10 which achieves the above-stated objectives.

Figure 1:
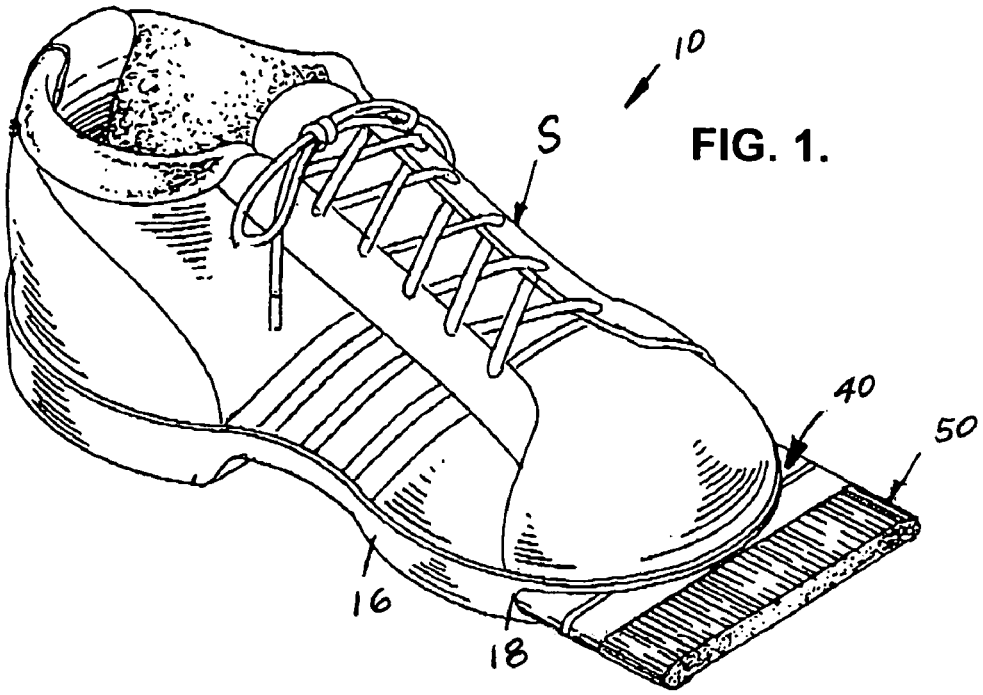
FIG. 1 is a perspective view of one form of the shoe-mounted umpire's brush embodying the present invention.

Brush unit 10 comprises a mounting strap unit 12 which encircles a shoe S when in use such as is shown in FIG. 1. Strap unit 12 includes a first strap 16, which has a first end 18 and a second end 20. A second strap 22 has a first end 24 and a second end 26. A first portion 28 of hook-and-loop fastening material is located on second end 20 of first strap 16 and a second portion 30 of hook-and-loop fastening material is located on second end 26 of second strap 22.

A brush-mounting element 40 is attached to the first ends 18, 24 of the straps 16, 22 of the mounting strap unit 12 and is adapted to fit over a toe section T of a shoe when in use.

A brush 50 is mounted on brush-mounting element 40 and is located to extend forward of the toe section of the shoe when in use.

Figure 2:
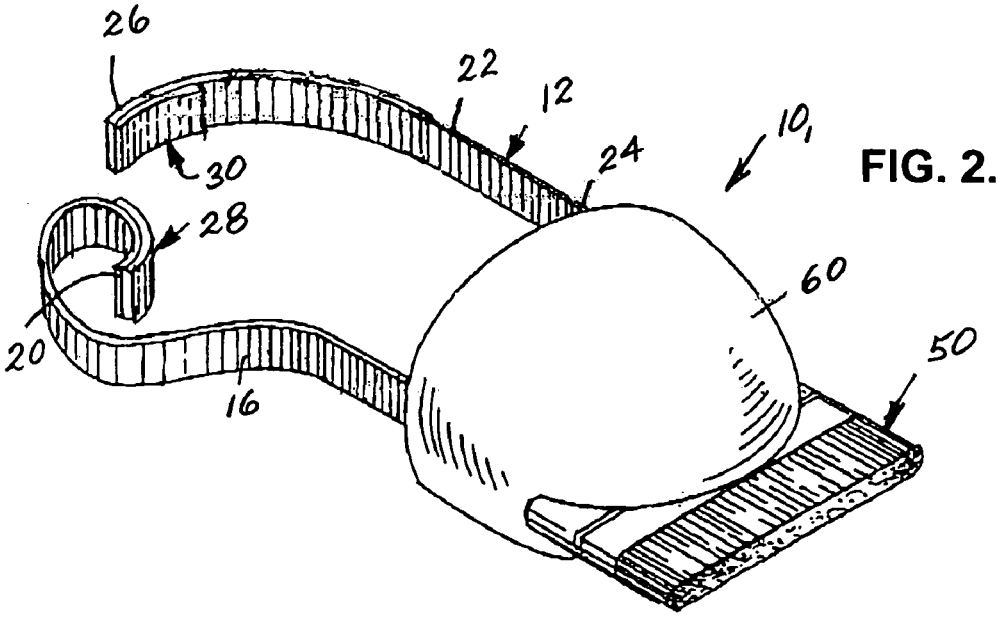
FIG. 2 is a perspective view of another form of the shoe-mounted umpire's brush embodying the present invention.

One form of the brush unit 10 is shown in FIG. 1 in which the brush-mounting element 40 is connected directly to the straps 16, 22. Another form of the brush unit is shown in FIG. 2 as unit $\mathbf{10}_1$. Unit $\mathbf{10}_1$ includes a toe plate 60 which will cover the toe section of the shoe in the manner of a protective plate known in the art. Toe plate 60 can be steel, plastic or any other hard material.

Figure 3:
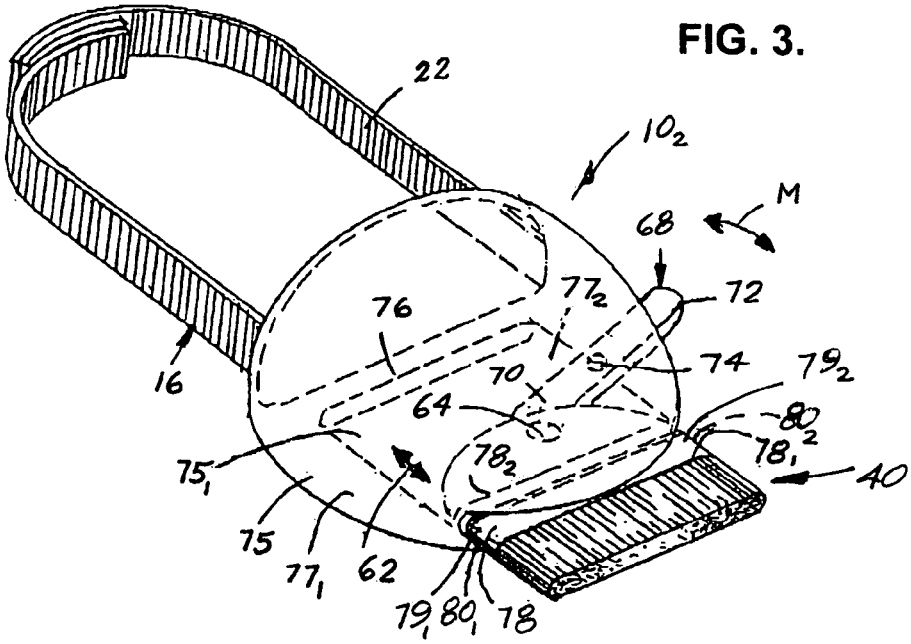
FIG. 3 is a perspective view of another form of the shoe-mounted umpire's brush embodying the present invention.

Yet another form of the unit is shown in FIG. 3 as unit $\mathbf{10}_2$. Unit $\mathbf{10}_2$ has brush 50 movably mounted on brush-mounting element 40 to move toward and away from the shoe as indicated by double-headed arrow 62. Unit $\mathbf{10}_2$ further includes a pivot connection 64 and a lever element 68 which has a first end 70 connected to the brush 50 and a second end 72 located outside of the toe plate 60. The lever has a fulcrum 74 on the toe plate 60 and moves as indicated by double-headed arrow M to move the brush in directions 62.

As shown in FIG. 3, brush-mounting element 40 includes a base plate 75 having a U-shaped cutout 75, defined therein. Base plate 75 includes a bight section 76 located adjacent to the toe section of shoe S and two legs $\mathbf{77}_1$ and $\mathbf{77}_2$ which extend from bight section 76 forward of the toe section. Brush 40 includes a body 78 which has a first end $\mathbf{78}_1$ which is a forward end when the brush 50 is in use, a second end $\mathbf{78}_2$ which is a rear end when the brush 50 is in use, a first side wall $\mathbf{79}_1$ a second side wall $\mathbf{79}_2$, a slot $\mathbf{80}_1$ in the first side wall $79_1$, and a slot $80_2$ in the second side wall $79_2$. The slots on the brush slidably accommodate the legs of the base plate 75 so the brush 50 can move in directions 62 under the influence of lever element 68.

Figure 4:
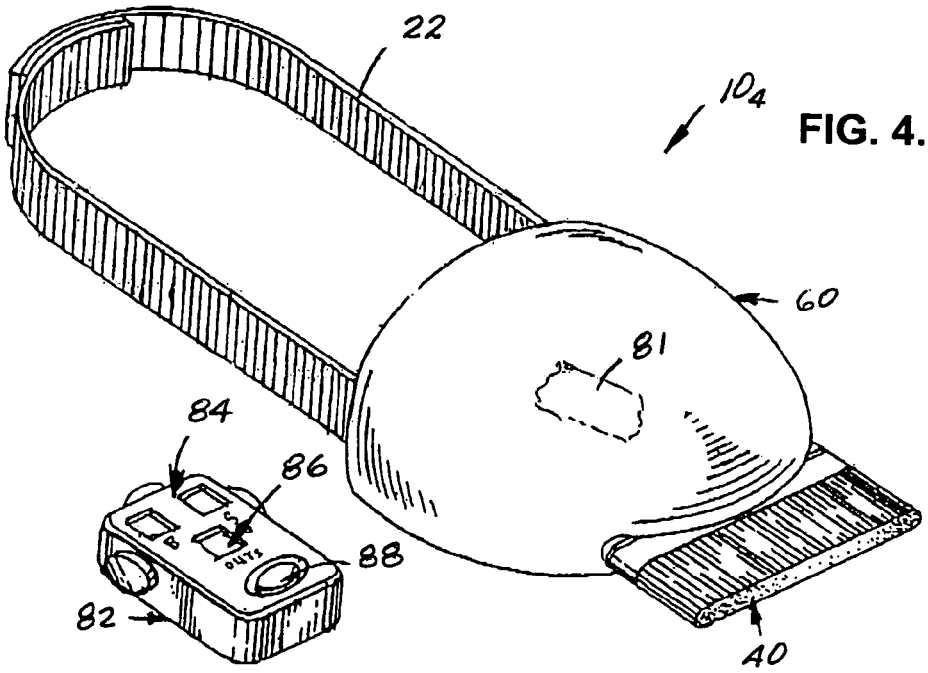
FIG. 4 is a perspective view of another form of the shoe-mounted umpire's brush embodying the present invention.

Yet another form of the unit is shown in FIG. 4 as unit $10_4$. Unit $10_4$ includes a movable connection movably connecting brush 40 to the brush-mounting element 40. The movable connection is the same as shown in FIG. 3 and discussed above, and thus will not be further discussed. A motor 81 is connected to the brush 50 to move the brush 50 when activated. In unit $10_4$, motor 81 simply replaces lever element 68 to move the brush 50 in directions 62. Motor 81 includes a drive shaft and gears, such as worm gears or the like, or simple threaded connections between an externally threaded shaft and an internally threaded bore, or the like, to connect the drive shaft to a corresponding connection on the brush 50 so rotation of the drive shaft in one direction will move the brush 50 outwardly of the shoe and rotation of the drive shaft in the opposite direction will move the brush 50 toward the shoe. The connection between the motor and the brush 50 will not be discussed as those skilled in the art will be able to understand how to effect such connection based on the teaching of this disclosure. It is also noted that the particular forms of the motor and the connection between the motor and the brush 50 do not form a part of this invention. The motor is remotely controlled by a hand-held remote control 82. Hand-held remote control 82 can also include a ball and strike counter mechanism as well as an out counter 86. Brush movement is controlled using button 88 which can be in the form of a joystick to control inward and outward movement of the brush.

It is understood that while certain forms of the present invention have been illustrated and described herein, it is not to be limited to the specific forms or arrangements of parts described and shown.

What is claimed is:

1. A shoe-mounted umpire's brush unit comprising:

(a) a mounting strap unit which encircles a shoe when in use and which includes a first strap having a first end and a second end, a second strap having a first end and a second end, a first portion of hook-and-loop fastening material on the second end of the first strap and a second portion of hook-and-loop fastening material on the second end of the second strap;

(b) a brush-mounting element attached to the first ends of the straps of said mounting strap unit and adapted to fit over a toe section of a shoe when in use, the brush-mounting element including a toe plate, a pivot connection, and a lever element having a first end connected to the brush and a second end located outside of the brush-mounting element, the lever having a fulcrum on the toe plate; a base plate having a U-shaped cutout defined therein, with the base plate including a bight section located adjacent to the toe section of a shoe, and two legs extending from the bight section forward of the toe section, the brush including a body having a first end which is a forward end when the brush is in use, a second end which is a rear end when the brush is in use, a first side wall, a second side wall, a slot in the first side wall, a slot in the second side wall, the slots on the brush slidably accommodating the legs of the base plate; and (c) a brush mounted on said brush-mounting element and located to extend forward of the toe section of the shoe when in use.

2. A shoe-mounted umpire's brush unit comprising:

(a) a mounting strap unit which encircles a shoe when in use and which includes a first strap having a first end and a second end, a second strap having a first end and a second end, a first portion of hook-and-loop fastening material on the second end of the first strap and a second portion of hook-and-loop fastening material on the second end of the second strap;

(b) a brush-mounting element attached to the first ends of the straps of said mounting strap unit and adapted to fit over a toe section of a shoe when in use, the brush-mounting element including a toe plate, a movable connection movably connecting the brush to the brush-mounting element, a motor connected to the brush, and a hand-held remote control associated with the motor for controlling the motor; and (c) a brush mounted on said brush-mounting element and located to extend forward of the toe section of the shoe when in use.

* * * * *